US012768002B2

(12) United States Patent
Bang et al.

(10) Patent No.: US 12,768,002 B2
(45) Date of Patent: Oct. 20, 2026

(54) HIGH-YIELD-RATIO ULTRA-HIGH-STRENGTH STEEL SHEET HAVING EXCELLENT THERMAL STABILITY, AND MANUFACTURING METHOD THEREFOR

(71) Applicant: POSCO CO., LTD, Pohang-si (KR)

(72) Inventors: Chan-Woo Bang, Gwangyang-si (KR); Sung-Il Kim, Gwangyang-si (KR); Hyun-Taek Na, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 407 days.

(21) Appl. No.: 18/267,767

(22) PCT Filed: Nov. 18, 2021

(86) PCT No.: PCT/KR2021/017014
§ 371 (c)(1),
(2) Date: Jun. 15, 2023

(87) PCT Pub. No.: WO2022/139190
PCT Pub. Date: Jun. 30, 2022

(65) Prior Publication Data

US 2023/0392228 A1 Dec. 7, 2023

(30) Foreign Application Priority Data

Dec. 21, 2020 (KR) ..... 10-2020-0180309

(51) Int. Cl.

| | |
|---|---|
| ***C21D 9/46*** | (2006.01) |
| ***C21D 8/02*** | (2026.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 9/46* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2006/0081312 | A1 | 4/2006 | Yokoi et al. | |
| 2018/0355453 | A1* | 12/2018 | Seo | C21D 9/46 |
| 2020/0157651 | A1 | 5/2020 | Xiao | |
| 2020/0385840 | A1 | 12/2020 | Kim et al. | |
| 2021/0010098 | A1 | 1/2021 | Na et al. | |
| 2021/0071278 | A1 | 3/2021 | Seo et al. | |
| 2021/0164077 | A1 | 6/2021 | Kim et al. | |

FOREIGN PATENT DOCUMENTS

| | | | | |
|---|---|---|---|---|
| CN | 103320717 | A | 9/2013 | |
| CN | 111448331 | A | 7/2020 | |
| CN | 111465710 | A | 7/2020 | |
| CN | 111511935 | A | 8/2020 | |
| EP | 3730648 | A1 * | 10/2020 | C22C 38/38 |
| JP | 2014218692 | | 11/2014 | |
| KR | 100358939 | | 1/2003 | |
| KR | 100962745 | | 6/2010 | |
| KR | 20120001013 | | 1/2012 | |
| KR | 20120044151 | | 5/2012 | |
| KR | 101246390 | | 3/2013 | |
| KR | 101290382 | | 7/2013 | |
| KR | 20150007609 | A | 1/2015 | |
| KR | 20160089316 | | 7/2016 | |
| KR | 101736620 | | 5/2017 | |

(Continued)

OTHER PUBLICATIONS

The impact of Specimen's Temperature on Tensile testing Results.*
International Search Report—PCT/KR2021/017014 dated Apr. 20, 2022.
Japanese Office Action—Japanese Application No. 2023-537431 issued on Aug. 6, 2024, citing WO 2019/124765, WO 2019/124776, and US 2020/0157651.
Chinese Office Action—Chinese Application No. 202180086362.5 issued on Dec. 15, 2025, citing CN 111448331 A, KR 10-2015-0007609 A, KR 10-2018-0068100 A, CN 111465710 A, KR 10-2019-0049154 A, and CN 103320717 A.

(Continued)

*Primary Examiner* — Jenny R Wu
(74) *Attorney, Agent, or Firm* — CANTOR COLBURN LLP

(57) ABSTRACT

Provided is an ultra-high-strength steel sheet having excellent thermal stability and a high yield ratio, and ultra-high strength even after heat treatment at a relatively low temperature, and a manufacturing method therefor. The steel sheet includes, by wt %, 0.05 to 0.13% of C, 0.01 to 0.5% of Si, 0.8 to 2.0% of Mn, 0.005 to 1.2% of Cr, 0.001 to 0.5 of Mo, 0.001 to 0.02% of P, 0.001 to 0.01% of S, 0.01 to 0.1% of Al, 0.001 to 0.01% of N, 0.01 to 0.05% of Ti, 0.001 to 0.03% of Nb, 0.001 to 0.2% of V, 0.0003 to 0.003% of B, and a balance of Fe and unavoidable impurities, and a microstructure including, by area %, 60 to 90% of martensite, including tempered martensite, 10 to 40% of bainite, and 5% or less of ferrite.

3 Claims, No Drawings

(56) References Cited

FOREIGN PATENT DOCUMENTS

| | | | |
|---|---|---|---|
| KR | 20180068100 | | 6/2018 |
| KR | 20190049154 | A | 5/2019 |
| KR | 20190075589 | | 7/2019 |
| KR | 20190076788 | | 7/2019 |
| WO | 2019124765 | A1 | 6/2019 |
| WO | 2019124776 | A1 | 6/2019 |

OTHER PUBLICATIONS

Chinese Decision of Grant—Chinese Application No. 202180086362.5 issued on Apr. 23, 2026, citing CN 111511935 A.

* cited by examiner

HIGH-YIELD-RATIO ULTRA-HIGH-STRENGTH STEEL SHEET HAVING EXCELLENT THERMAL STABILITY, AND MANUFACTURING METHOD THEREFOR

TECHNICAL FIELD

The present disclosure relates to an ultra-high-strength steel sheet and a method for manufacturing the same, and in particular, to a high-yield-ratio ultra-high-strength steel sheet having excellent thermal stability and a method for manufacturing the same.

BACKGROUND ART

In the case of steel sheets used in the boom arms of heavy equipment, frames and reinforcing members of commercial vehicles, and structural members of building and mechanical parts, a part or the whole of the steel sheet and parts may be applied with heat for various purposes during the manufacturing process and use. As an example, frames and reinforcing members of commercial vehicles often require local shape adjustment for coupling with parts, and for this purpose, local heating and deformation are applied to steel. Meanwhile, strength of the steel changes due to the heating process, resulting in deterioration of durability. This is because carbon in a solid solution is rearranged during the heating process, or clustering is formed at dislocations, grain boundaries, and the like, to form carbides, thereby causing brittleness of the steel. In addition, microstructures such as martensite, bainite, and retained austenite in steel also change, such that the strength of the steel rapidly changes, which may affect formability and durability.

As such, a change in structure and physical properties of the steel during the heating process varies depending on initial elements and microstructures of the steel, and is highly dependent on heat treatment conditions such as a heating temperature and a holding time. To date, the focus has only been on suppressing a decrease in strength at a high temperature of 600° C. or higher.

For example, Patent Documents 1 and 2 disclose a technique for securing high-temperature strength by adding Cr, Mo, Nb, V, and the like, as alloy components and using tempering and the like after hot-rolling, but this is only a technique suitable for manufacturing thick steel for building construction. In addition, considering environmental factors such as fire, in which steel for building construction is inevitably heated, when large amounts of alloy components such as Cr, Mo, Nb, and V are added to steel, the strength may be secured at a certain level even when exposed to a high temperature of 600° C. or higher for a long time, but an excessive manufacturing cost is required for tempering and the like. In particular, when the steel is exposed to an environment of 600° C. or lower for a short time, thermal stability is excessive for use thereof.

Patent Document 3 discloses a technique for securing strength in a welding heat-affected zone by adding Ti, Nb, Cr, Mo, and the like, and it is suitable for suppressing softening in a zone adjacent to a weld zone during welding of structural members of vehicles. However, there is a limit because during arc welding, a region adjacent to the welding material melted by welding heat is heated to a high temperature of 600° C. or higher, and in particular, this region is heated to a temperature higher than that in an austenite region.

Patent Document 4 discloses a technique for securing high-temperature strength by adding Cr, Mo, Ti, Nb, V, and the like, and by this technique, strength of steel is also secured when exposed at a high temperature of 600° C. or higher for a long time. However, when steel is manufactured under the given component system and manufacturing conditions, only tensile strength (TS) of 530 MPa class may be secured, which is different from Giga-class ultra-high-strength steel in terms of use and strength.

RELATED ART DOCUMENT (Patent Document 1) Korean Patent No. 10-0358939 (published on Oct. 16, 2002)

(Patent Document 2) Korean Patent No. 10-1290382 (published on Jul. 22, 2013)

(Patent Document 3) Korean Patent No. 10-0962745 (published on Jun. 3, 2010)

(Patent Document 4) Korean Patent No. 10-1246390 (published on Mar. 21, 2013)

DISCLOSURE

Technical Problem

An aspect of the present disclosure is to provide a steel sheet that has excellent thermal stability and thus has a high yield ratio and ultra-high strength even after a heat treatment at a relatively low temperature, and a method for manufacturing the same.

An object of the present disclosure is not limited to the above description. Those skilled in the art will have no difficulty in understanding further objects of the present disclosure from the overall descriptions of the present specification.

Technical Solution

According to an aspect of the present disclosure, a steel sheet comprises, by wt %, 0.05 to 0.13% of C, 0.01 to 0.5% of Si, 0.8 to 2.0% of Mn, 0.005 to 1.2% of Cr, 0.001 to 0.5 of Mo, 0.001 to 0.02% of P, 0.001 to 0.01% of S, 0.01 to 0.1% of Al, 0.001 to 0.01% of N, 0.01 to 0.05% of Ti, 0.001 to 0.03% of Nb, 0.001 to 0.2% of V, 0.0003 to 0.003% of B, and a balance of Fe and unavoidable impurities, wherein a K value defined in the following Relational Expression 1 is −1.05 or greater, a G value defined in the following Relational Expression 2 is 2 to 20, a microstructure comprises, by area %, 60 to 90% of martensite (including tempered martensite), 10 to 40% of bainite, and 5% or less of ferrite, and a yield ratio of the steel sheet is 0.8 or more.

$$K=-0.6-1.42[C]+0.05[Si]-0.16[Mn]-0.08[Cr]-0.03[Mo]+0.09[Ti]+0.08[Nb]^2 \quad \text{[Relational Expression 1]}$$

(where [C], [Si], [Mn], [Cr], [Mo], [Ti], and [Nb] are wt % of the corresponding alloy components.)

$$G=([Nb]/93+[Mo]/96+[V]/51)/([Ti]/48) \quad \text{[Relational Expression 2]}$$

(where [Nb], [Mo], [V], and [Ti] are wt % of the corresponding alloy components.)

A tensile strength of the steel sheet may be 950 MPa or more.

A tensile strength of the steel sheet after a heat treatment at 400 to 600° C. may be 80% or more of a tensile strength before the heat treatment.

According to another aspect of the present disclosure, a method for manufacturing a steel sheet includes: reheating a steel slab comprising, by wt %, 0.05 to 0.13% of C, 0.01 to 0.5% of Si, 0.8 to 2.0% of Mn, 0.005 to 1.2% of Cr, 0.001 to 0.5 of Mo, 0.001 to 0.02% of P, 0.001 to 0.01% of S, 0.01 to 0.1% of Al, 0.001 to 0.01% of N, 0.01 to 0.05% of Ti, 0.001 to 0.03% of Nb, 0.001 to 0.2% of V, 0.0003 to 0.003% of B, and a balance of Fe and unavoidable impurities, and having a K value defined in the following Relational Expression 1 of −1.05 or greater and a G value defined in the following Relational Expression 2 of 2 to 20;

hot rolling the reheated steel slab; and primarily cooling the hot-rolled steel sheet to a temperature range of 300 to 500° C. at a cooling rate of 60° C./s or more, secondarily cooling the primarily cooled steel sheet to a temperature range of 50 to 200° C. at a cooling rate of 10 to 70° C./s, and then coiling the secondarily cooled steel sheet.

$$K=-0.6-1.42[C]+0.05[Si]-0.16[Mn]-0.08[Cr]-0.03[Mo]+0.09[Ti]+0.08[Nb]^2 \quad \text{[Relational Expression 1]}$$

(where [C], [Si], [Mn], [Cr], [Mo], [Ti], and [Nb] are wt % of the corresponding alloy components.)

$$G=([Nb]/93+[Mo]/96+[V]/51)/([Ti]/48) \quad \text{[Relational Expression 2]}$$

(where [Nb], [Mo], [V], and [Ti] are wt % of the corresponding alloy components.)

In the reheating of the steel slab, a reheating temperature may be 1,150 to 1,350° C., and in the hot-rolling of the reheated steel slab, a rolling end temperature may be 850 to 1,150° C.

In the cooling, the secondary cooling rate may be 60° C. or lower.

Advantageous Effects

According to an aspect of the present disclosure, it is possible to provide a steel sheet that has excellent thermal stability and thus has a high yield ratio and ultra-high strength even after a heat treatment at a relatively low temperature, and a method for manufacturing the same.

According to an aspect of the present disclosure, it is possible to provide an ultra-high-strength steel sheet that may be subjected to a heat treatment at a relatively low temperature for a short time and thus may be widely used, and a method for manufacturing the same.

BEST MODE FOR INVENTION

Hereinafter, preferred exemplary embodiments in the present disclosure will be described. The exemplary embodiments in the present disclosure may be modified in various forms, and the scope of the present disclosure should not be interpreted to be limited to the exemplary embodiments set forth below. The exemplary embodiments are provided in order to describe the present disclosure in more detail to those skilled in the art to which the present disclosure pertains.

In order to solve the above problems of the related art, as a result of measuring a change in tensile strength at room temperature after a heat treatment of steel having various elements and microstructures in a temperature range of 400 to 600° C., the present inventors have found that the change in tensile strength depends on a slope of a dynamic strength value measured during a temperature rise of the steel.

The present inventors derived Relational Expressions 1 and 2 that optimize the element contents of C, Mn, Si, Cr, Mo, Ti, Nb, and V, the main elements of steel, and also have found that excellent stability could be secured by controlling the conditions of the manufacturing process, thereby completing the present disclosure.

Hereinafter, the present disclosure will be described in detail.

Hereinafter, a steel composition of the present disclosure will be described in detail.

In the present disclosure, unless otherwise specified, % indicating a content of each element is based on weight.

A steel sheet according to an aspect of the present disclosure may comprise, by wt %, 0.05 to 0.13% of C, 0.01 to 0.5% of Si, 0.8 to 2.0% of Mn, 0.005 to 1.2% of Cr, 0.001 to 0.5 of Mo, 0.001 to 0.02% of P, 0.001 to 0.01% of S, 0.01 to 0.1% of Al, 0.001 to 0.01% of N, 0.01 to 0.05% of Ti, 0.001 to 0.03% of Nb, 0.001 to 0.2% of V, 0.0003 to 0.003% of B, and a balance of Fe and unavoidable impurities.

Carbon (C): 0.05 to 0.13%

Carbon (C) is the most economical and effective element for strengthening steel, and when the amount of C added increases, a tensile strength increases due to an increase in martensite or bainite fraction. When a content of carbon (C) is less than 0.05%, it is difficult to sufficiently obtain the effect described above, and when the content of carbon (C) exceeds 0.13%, the strength of martensite increases due to excess carbon, but when a heat treatment in a range of 400 to 600° C. is performed, a solid solution strengthening effect of carbon (C) may be greatly reduced.

Therefore, the content of carbon (C) may be 0.05 to 0.13%, a more preferred lower limit thereof may be 0.07%, and a more preferred upper limit thereof may be 0.11%.

Silicon (Si): 0.01 to 0.5%

Silicon (Si) has an effect of deoxidizing molten steel and a solid solution strengthening effect, and is an element advantageous for improving formability by delaying formation of coarse carbides. When a content of silicon (Si) is less than 0.01%, it is difficult to obtain the effect described above. On the other hand, when the content thereof exceeds 0.5%, red scale due to silicon (Si) may be formed on a surface of the steel sheet during hot-rolling, which causes not only significant deterioration of surface quality of the steel sheet but also deterioration of weldability.

Therefore, the content of silicon (Si) may be 0.01 to 0.5%, and a more preferred upper limit thereof may be 0.3%.

Manganese (Mn): 0.8 to 2.0%

Similar to Si, manganese (Mn) is an element effective for solid solution strengthening of steel, and may increase hardenability of steel to facilitate formation of martensite and bainite during cooling after the heat treatment. When a content of manganese (Mn) is less than 0.8%, the above effect by the addition cannot be obtained, and when the content thereof exceeds 2.0%, it is advantageous to secure initial strength, but when a heat treatment in a range of 400 to 600° C. is performed, a difference between the initial strength and the strength after the heat treatment may increase. In addition, during casting of a slab in a continuous process, a segregation portion is greatly developed in a thickness central portion, which may cause deviation, and formation of MnS is facilitated, which may cause deterioration of ductility.

Therefore, the content of manganese (Mn) may be 0.8 to 2.0%, a more preferred lower limit thereof may be 1.0%, and a more preferred upper limit thereof may be 1.8%.

Chromium (Cr): 0.005 to 1.2%

Chromium (Cr) strengthens solid solution of steel, and serves to help formation of martensite and bainite by delaying ferrite transformation during cooling. In addition, chromium (Cr) contributes to the strength after the heat treatment by precipitation of fine composite carbides with Mo, Ti, Ni, and the like. When a content of chromium (Cr) is less than 0.005%, the above effect by the addition cannot be obtained, and when the content thereof exceeds 1.2%, similar to Mn, a segregation portion may be greatly developed in the thickness central portion, a microstructure in a thickness direction may be non-uniform, and alloy costs may be disadvantageous.

Therefore, the content of chromium (Cr) may be 0.005 to 1.2%, and a more preferred lower limit thereof may be 0.4%.

Molybdenum (Mo): 0.001 to 0.5%

Molybdenum (Mo) increases hardenability of steel and facilitates formation of martensite and bainite. In addition, molybdenum (Mo) forms Nb—Ti-Mo-based fine carbides during the heat treatment to mitigate a decrease in strength. When a content of molybdenum (Mo) is less than 0.001%, the above effect by the addition cannot be obtained, and when the content thereof exceeds 0.5%, it may be economically disadvantageous.

Therefore, the content of molybdenum (Mo) may be 0.001 to 0.5%, a more preferred lower limit thereof may be 0.05%, and a more preferred upper limit thereof may be 0.3%.

Phosphorus (P): 0.001 to 0.02%

Phosphorus (P) has a solid solution strengthening effect, but may cause brittleness due to grain boundary segregation. In order to manufacture the steel sheet with a content of phosphorus (P) of less than 0.001%, a lot of manufacturing cost is required, which is economically disadvantageous and is insufficient to obtain strength. On the other hand, when the content thereof exceeds 0.02%, brittleness due to grain boundary segregation may occur, and microcracks are likely to occur during forming, which may significantly deteriorate ductility and impact resistance.

Therefore, the content of phosphorus (P) may be 0.001 to 0.02%.

Sulfur (S): 0.001 to 0.01%

Sulfur (S) is an impurity present in steel. When a content of sulfur (S) exceeds 0.01%, sulfur (S) is combined with Mn and the like to form a non-metallic inclusion. Accordingly, microcracks are likely to occur during steel cutting processing, and impact resistance is significantly deteriorated. Meanwhile, in order to manufacture the steel sheet with the content of sulfur (S) of less than 0.001%, during a steelmaking operation, a lot of time is required, which may cause a decrease in productivity.

Therefore, the content of sulfur (S) may be 0.001 to 0.01%.

Aluminum (Al): 0.01 to 0.1%

Aluminum (Al) is mainly added for deoxidation. When a content of aluminum (Al) is less than 0.01%, the addition effect is insufficient, and when the content thereof exceeds 0.1%, Al is combined with N to form AlN, such that corner cracks are likely to occur in the slab during continuous casting, and defects due to inclusion formation are likely to occur.

Therefore, the content of aluminum (Al) may be 0.01 to 0.1%, a more preferred lower limit thereof may be 0.02%, and a more preferred upper limit thereof may be 0.05%.

Nitrogen (N): 0.001 to 0.01%

Nitrogen (N) is a representative solid solution strengthening element like C, and forms coarse precipitates together with Ti, Al, and the like. In general, although the solid solution strengthening effect of nitrogen (N) is superior to that of C, toughness significantly decreases as the amount of nitrogen (N) in steel increases. Therefore, an upper limit thereof is limited to 0.01%. On the other hand, in order to manufacture the steel sheet with a content of nitrogen (N) of less than 0.001%, during a steelmaking operation, an excessive amount of time is required, which may cause a decrease in productivity.

Therefore, the content of nitrogen (N) may be 0.001 to 0.01%.

Titanium (Ti): 0.01 to 0.05%

Titanium (Ti) is a representative precipitation strengthening element like Nb, Mo, and V, and contributes to mitigating a decrease in strength due to carbide formation after the heat treatment. However, the effect is insufficient because a precipitate formation temperature is higher than those of other precipitation elements. In addition, Ti forms coarse TiN with a strong affinity with N. Such TiN has an effect of suppressing grain growth during a heat process for hot-rolling, and is advantageous to utilize B added to improve hardenability because dissolved N is stabilized. When a content of titanium (Ti) is less than 0.01%, it is difficult to obtain the above effect, and when the content thereof exceeds 0.05%, impact resistance in a low-temperature region may be deteriorated due to formation of coarse TiN and coarsening of precipitates during the heat treatment.

Therefore, the content of titanium (Ti) may be 0.01 to 0.05%, and a more preferred upper limit thereof may be 0.03%.

Niobium (Nb): 0.001 to 0.03%

Niobium (Nb) is a representative precipitation strengthening element like Ti and V, and forms carbides during hot-rolling, which is effective in improving strength and impact toughness of steel due to a grain refinement effect caused by recrystallization delay. The content of C in steel decreases due to formation of carbides, and when a heat treatment in a range of 400 to 600° C. is performed, the strength decrease effect by C is mitigated. When the content of niobium (Nb) is less than 0.001%, the above effect cannot be obtained, and when the content thereof exceeds 0.03%, recrystallization may be excessively delayed due to precipitates formed during rolling and anisotropy of the steel may be deteriorated.

Therefore, the content of niobium (Nb) may be 0.001 to 0.03%, and a more preferred upper limit thereof may be 0.02%.

Vanadium (V): 0.001 to 0.2%

Vanadium (V) is a strong precipitation hardening element, and is an element that actively precipitates in a reheating temperature range. During the reheating, it is preferable to add 0.001% or more of vanadium (V) as an element that may compensate for the decrease in strength due to annealing of martensite by forming precipitates, but when the content thereof exceeds 0.2%, it may be disadvantageous in terms of economy.

Therefore, the content of vanadium (V) may be 0.001 to 0.2%.

Boron (B): 0.0003 to 0.003%

Boron (B) delays ferrite transformation and is advantageous in securing initial strength through bainite and martensite. When boron (B) is present in a solid solution state, boron (B) may be effective in preventing brittleness of steel in a low temperature range by stabilizing grain boundaries, and boron forms BN together with solid solution N, which may suppress formation of coarse nitrides. When a content of boron (B) is less than 0.0003%, it is difficult to obtain the above effect, and when the content thereof exceeds 0.003%, it contributes to the improvement of initial strength, but does not significantly contribute to the improvement of strength after the heat treatment, which may cause a significant decrease in strength after the heat treatment.

Therefore, the content of boron (B) may be 0.0003 to 0.003%.

The steel sheet of the present disclosure may contain a balance of iron (Fe) and unavoidable impurities in addition to the composition described above. Since the unavoidable impurities may be unintentionally incorporated in a general manufacturing process, the unavoidable impurities may not be excluded. Since these impurities are known to those skilled in a general steel manufacturing field, all the contents thereof are not particularly described in the present specification.

In the steel sheet of the present disclosure, a K value defined in the following Relational Expression 1 may be −1.05 or greater.

Thermal stability of steel related to the K value in Relational Expression 1 is based on deformation resistance of the steel to an external force applied to the steel at a given temperature. As an example, a high-temperature compression test or a high-temperature tensile test is performed on the steel, and during the test, the material is heated at a constant heating rate and an external force is applied at a constant deformation rate to measure the force applied per unit area to the material. In this way, a slope value of the measured stress-temperature curve is called thermal stability, which may be a unique feature of the steel.

In the present disclosure, the thermal stability of steel was measured by applying the high-temperature compression test, and at this time, the steel was heated to 600° C. at a temperature increase rate of 1° C./s, and a deformation amount of 30% was applied at a deformation rate of 0.005/s. At this time, the slope K of the obtained stress-temperature curve was obtained for various types of steels, and Relational Expression (1) could be derived.

When the K value of Relational Expression 1 is less than −1.05, the thermal stability is insufficient, and thus the change in strength before and after a heat treatment at 100 to 600° C. may be increased. In particular, a change in yield strength before and after the heat treatment may exhibit a more stable tendency when Relational Expression 2 is also satisfied. More preferably, the K value of Relational Expression 1 may be −1.03 or greater.

$$K=-0.6-1.42[C]+0.05[Si]-0.16[Mn]-0.08[Cr]-0.03[Mo]+0.09[Ti]+0.08[Nb]^2 \quad \text{[Relational Expression 1]}$$

(where [C], [Si], [Mn], [Cr], [Mo], [Ti], and [Nb] are wt % of the corresponding alloy components.)

In the steel sheet of the present disclosure, a G value defined in the following Relational Expression 2 may be 2 to 20.

When Relational Expressions 1 and 2 are simultaneously satisfied, the thermal stability may be secured by mitigating the decrease in strength after the heat treatment.

The following Relational Expression 2 represents an element formula of strength after a heat treatment by precipitates, and relates to formation of precipitates in fine grains generated during the heat treatment. The precipitates have the effect of compensating for the decrease in strength caused by dislocations and dissolved carbon, but when the G value is less than 2, the formation of precipitates in the steel sheet after the heat treatment is insufficient or the formation of coarse precipitates in the initial steel sheet is increased. Therefore, during the heat treatment, the formation of precipitates in fine grains may be decreased, and thus the thermal stability may be insufficient. On the other hand, when the G value exceeds 20, the effect of further improving the thermal stability may be reduced, and it may be economically disadvantageous because a large amount of expensive alloy components should be added. The G value may be more preferably 3 or greater and still more preferably 17 or less.

$$G=([Nb]/93+[Mo]/96+[V]/51)/([Ti]/48) \quad \text{[Relational Expression 2]}$$

(where [Nb], [Mo], [V], and [Ti] are wt % of the corresponding alloy components.)

Hereinafter, a microstructure of the steel of the present disclosure will be described in detail.

In the present disclosure, unless otherwise specified, % indicating a fraction of a microstructure is based on area.

A microstructure of the steel sheet according to an aspect of the present disclosure may comprise, by area %, 60 to 90% of martensite (including tempered martensite), 10 to 40% of bainite, and 5% or less of ferrite.

Martensite is a structure that is disadvantageous for securing thermal stability, but is necessary for securing initial strength. Martensite may secure strength by solid solution with C and lattice distortion, but during the heat treatment, the above effect disappears, and thus a significantly large change in strength may occur.

When a fraction of martensite exceeds 90%, the change in strength after the heat treatment is large, and the strength after the heat treatment is not satisfied. On the other hand, when the fraction thereof less than 60%, initial strength may not be secured. Bainite is more disadvantageous than martensite in securing initial strength, but is advantageous in a change in strength after the heat treatment. In the present disclosure, the fraction of martensite including a fraction of tempered martensite is indicated.

When a fraction of bainite exceeds 40%, initial strength may not be secured, and when the fraction thereof is less than 10%, the change in strength after the heat treatment may be increased. In addition, as a microstructure, ferrite may be contained in an amount of 5% or less, but when the content thereof exceeds 5%, it is disadvantageous to secure initial strength.

Hereinafter, a method for manufacturing steel of the present disclosure will be described in detail.

Steel according to an aspect of the present disclosure may be manufactured by subjecting a steel slab satisfying the alloy composition described above to reheating, hot-rolling, cooling, and coiling.

Slab Reheating

A steel slab satisfying the alloy composition described above may be reheated in a temperature range of 1,150 to 1,350° C.

When a reheating temperature is less than 1,150° C., precipitation forming elements such as Nb and Ti are not sufficiently re-dissolved. Thus, in the heat treatment of the manufactured steel sheet, formation of precipitates is reduced, and coarse TiN remains, such that it may be difficult to resolve segregation generated by diffusion during casting. On the other hand, when the reheating temperature exceeds 1,350° C., a decrease in strength and structure non-uniformity may occur due to abnormal grain growth of austenite grains.

Hot-Rolling

The reheated steel slab may be hot-rolled at a rolling end temperature of 850 to 1,150° C.

When the rolling end temperature exceeds 1,150° C., as the temperature of the hot-rolled steel sheet increases, a grain size may be coarsened, and the final transformed structure may become non-uniform. On the other hand, when the rolling end temperature is less than 850° C., as grains elongated due to excessive recrystallization delay are developed, anisotropy may become severe, and the formability may also be deteriorated. In particular, Nb carbides are formed by deformation induced precipitation, which may be disadvantageous to the formation of fine carbides during the heat treatment.

Cooling and Coiling

The hot-rolled steel sheet may be primarily cooled to a temperature range of 300 to 500° C. at a cooling rate of 60° C./s or more, the primarily cooled steel sheet may be secondarily cooled to a temperature range of 50 to 200° C. at a cooling rate of 10 to 70° C./s, and then the secondarily cooled steel sheet may be coiled.

In the present disclosure, the microstructure is optimized to secure the desired mechanical properties, and to this end, the cooling process may be divided into two steps.

During the primary cooling, when the cooling rate is less than 60° C./s, the strength of the manufactured steel sheet may be deteriorated due to formation of ferrite. In addition, when a primary cooling end temperature exceeds 500° C., ferrite is formed and initial strength of the steel sheet decreases, and on the other hand, when the primary cooling end temperature is less than 300° C., it is difficult to form bainite in the steel sheet, which is advantageous in securing initial strength, but the decrease in strength after the heat treatment may be large.

In the secondary cooling, the steel sheet is cooled to a temperature range of 50 to 200° C., auto-tempering occurs and fine carbides are precipitated. This causes a decrease in initial tensile strength, but causes an increase in yield strength, which allows the steel sheet to have a high yield ratio, and it is effective in mitigating the decrease in strength during the heat treatment. In the secondary cooling, when a cooling end temperature is less than 50° C., auto-tempering does not occur, and the decrease in strength after the heat treatment becomes large, and when the cooling end temperature exceeds 200° C., the auto-tempering effect may be excessive, which may cause coarsening of carbides and an increase in brittleness of steel and may affect fine precipitation of Nb and Ti at a high temperature. More preferably, the secondary cooling rate may be 10 to 60° C./s. When the secondary cooling rate exceeds 70° C./s, as auto-tempering does not occur, the yield ratio is low and the initial tensile strength is high, the decrease in strength after the heat treatment may be large. On the other hand, when the secondary cooling rate is less than 10° C./s, the auto-tempering effect may be excessive.

In the case of the steel of the present disclosure manufactured as described above, a tensile strength is 950 MPa or more, a yield ratio is 0.8 or more, and a tensile strength after a heat treatment at 400 to 600° C. is 80% or more of a tensile strength before the heat treatment, such that thermal stability may be excellent and a high yield ratio and ultra-high strength characteristics may be provided.

Hereinafter, the present disclosure will be described in more detail with reference to Examples. However, the following Examples are provided to illustrate and describe the present disclosure in detail, but are not intended to limit the scope of the present disclosure.

MODE FOR INVENTION

Table 1 shows alloy components according to steel types and results of calculating Relational Expressions 1 and 2 through the alloy components. Steel sheets were manufactured using the respective steel types in Table 1 under the conditions shown in Table 2. Table 2 shows the rolling end temperature, the primary and secondary cooling end temperatures, and the primary and secondary cooling rates. As the reheating temperature not shown in Table 2, a temperature of 1,250° C. was applied, and the steel was manufactured to have a thickness of 3 mm after hot-rolling in all the steel types.

TABLE 1

| Steel | Alloy components (wt %) | | | | | | | | | | | | | Relational Expression | Relational Expression |
|---|---|---|---|---|---|---|---|---|---|---|---|---|---|---|---|
| type | C | Si | Mn | Cr | Al | P | S | N | Mo | Ti | Nb | B | V | 1 (K value) | 2 (G value) |
| A | 0.04 | 0.03 | 1 | 0.96 | 0.03 | 0.009 | 0.003 | 0.004 | 0.23 | 0.02 | 0.015 | 0.001 | 0.003 | −0.90 | 6.14 |
| B | 0.15 | 0.3 | 1.8 | 0.2 | 0.03 | 0.007 | 0.003 | 0.003 | 0.3 | 0.015 | 0.005 | 0.0015 | 0.1 | −1.11 | 16.45 |
| C | 0.08 | 0.25 | 2.2 | 0.8 | 0.02 | 0.008 | 0.002 | 0.004 | 0.1 | 0.02 | 0.01 | 0.002 | 0.07 | −1.12 | 6.05 |
| D | 0.06 | 0.5 | 0.5 | 0.5 | 0.04 | 0.006 | 0.002 | 0.003 | 0.3 | 0.03 | 0.03 | 0.0025 | 0.1 | −0.79 | 8.65 |
| E | 0.07 | 0.01 | 1.2 | 0.8 | 0.04 | 0.01 | 0.003 | 0.003 | 0.1 | 0.01 | 0.005 | 0.002 | 0.05 | −0.96 | 9.96 |
| F | 0.06 | 0.1 | 1.2 | 0.7 | 0.02 | 0.005 | 0.002 | 0.005 | 0.1 | 0.025 | 0.02 | 0.001 | 0.1 | −0.93 | 6.18 |
| G | 0.09 | 0.1 | 1.5 | 0.8 | 0.02 | 0.005 | 0.002 | 0.004 | 0.2 | 0.025 | 0.02 | 0.002 | 0.002 | −1.03 | 4.41 |
| H | 0.12 | 0.41 | 1.5 | 0.5 | 0.03 | 0.006 | 0.003 | 0.003 | 0.005 | 0.03 | 0.01 | 0.001 | 0.01 | −1.03 | 0.57 |
| I | 0.08 | 0.1 | 1.5 | 0.4 | 0.04 | 0.01 | 0.003 | 0.003 | 0.15 | 0.02 | 0.025 | 0.002 | 0.1 | −0.98 | 9.10 |
| J | 0.08 | 0.1 | 1.6 | 0.5 | 0.04 | 0.01 | 0.003 | 0.003 | 0.1 | 0.02 | 0.025 | 0.001 | 0.05 | −1.01 | 5.50 |
| K | 0.06 | 0.1 | 1.2 | 0.9 | 0.02 | 0.005 | 0.002 | 0.005 | 0.1 | 0.025 | 0.02 | 0.002 | 0.1 | −0.94 | 6.18 |
| L | 0.08 | 0.4 | 1.4 | 0.7 | 0.03 | 0.009 | 0.003 | 0.0042 | 0.2 | 0.02 | 0.005 | 0.0015 | 0.1 | −0.98 | 9.83 |
| M | 0.1 | 0.3 | 1.1 | 0.8 | 0.03 | 0.006 | 0.003 | 0.004 | 0.4 | 0.02 | 0.01 | 0.002 | 0.001 | −0.98 | 10.31 |
| N | 0.09 | 0.2 | 1.4 | 0.7 | 0.03 | 0.007 | 0.003 | 0.004 | 0.1 | 0.02 | 0.01 | 0.0018 | 0.03 | −1.00 | 4.17 |
| O | 0.08 | 0.05 | 1.5 | 0.9 | 0.03 | 0.007 | 0.003 | 0.004 | 0.25 | 0.02 | 0.005 | 0.0017 | 0.05 | −1.03 | 8.73 |
| P | 0.12 | 0.41 | 1.6 | 0.4 | 0.03 | 0.006 | 0.003 | 0.003 | 0.05 | 0.02 | 0.015 | 0.0015 | 0.05 | −1.04 | 3.99 |

$$K=-0.6-1.42[C]+0.05[Si]-0.16[Mn]-0.08[Cr]-0.03[Mo]+0.09[Ti]+0.08[Nb]^2 \quad \text{[Relational Expression 1]}$$

(where [C], [Si], [Mn], [Cr], [Mo], [Ti], and [Nb] are wt % of the corresponding alloy components.)

$$G=([Nb]/93+[Mo]/96+[V]/51)/([Ti]/48) \quad \text{[Relational Expression 2]}$$

(where [Nb], [Mo], [V], and [Ti] are wt % of the corresponding alloy components.)

TABLE 2

| Steel type | Hot-rolling Rolling end temperature (° C.) | Cooling: Primary cooling end temperature (° C.) | Cooling: Primary cooling rate (° C./s) | Cooling: Secondary cooling end temperature and coiling temperature (° C.) | Cooling: Secondary cooling rate (° C./s) |
|---|---|---|---|---|---|
| A | 910 | 451 | 76 | 124 | 45 |
| B | 897 | 336 | 81 | 112 | 31 |
| C | 902 | 421 | 68 | 137 | 39 |
| D | 884 | 387 | 78 | 152 | 41 |
| E | 885 | 511 | 65 | 189 | 49 |
| F | 891 | 449 | 40 | 121 | 41 |
| G | 888 | 359 | 89 | 128 | 89 |
| H | 879 | 401 | 75 | 123 | 49 |
| I | 885 | 267 | 62 | 51 | 51 |
| J | 894 | 406 | 74 | 26 | 59 |
| K | 884 | 400 | 71 | 135 | 43 |
| L | 904 | 403 | 76 | 167 | 46 |
| M | 899 | 384 | 72 | 119 | 39 |
| N | 889 | 378 | 82 | 151 | 34 |

TABLE 2-continued

| Steel type | Hot-rolling Rolling end temperature (° C.) | Cooling: Primary cooling end temperature (° C.) | Cooling: Primary cooling rate (° C./s) | Cooling: Secondary cooling end temperature and coiling temperature (° C.) | Cooling: Secondary cooling rate (° C./s) |
|---|---|---|---|---|---|
| O | 885 | 320 | 85 | 194 | 26 |
| P | 881 | 413 | 69 | 109 | 54 |

Table 3 shows microstructure and mechanical properties of the manufactured steel sheets. The measured fractions of ferrite, bainite, and martensite are shown, and the tensile strength and yield ratio (yield strength/tensile strength) of the manufactured steel are shown. In this case, the fraction of martensite including the fraction of tempered martensite was indicated. In addition, the tensile strength of the manufactured steel sheet after the heat treatment was measured, and a ratio of the tensile strength after the heat treatment to the tensile strength before the heat treatment was shown. The heat treatment was performed so that the steel sheet was heated to 500° C. and then the temperature was maintained for 15 minutes. The tensile test was performed by collecting a JIS-5 standard test piece in a direction parallel to a rolling direction, the microstructure was measured at a point of ¼ of the thickness of each steel type, and the tensile strength was measured from the results of analysis at ×3,000 and ×5,000 magnifications using SEM.

TABLE 3

| Steel type | Microstructure (area %): Ferrite | Microstructure (area %): Bainite | Microstructure (area %): Martensite | Mechanical properties before heat treatment: Tensile strength (MPa) | Mechanical properties before heat treatment: Yield ratio | Mechanical properties after heat treatment: Tensile strength (MPa) | Tensile strength ratio before and after heat treatment | Classification |
|---|---|---|---|---|---|---|---|---|
| A | 5 | 52 | 43 | 948 | 0.83 | 801 | 0.84 | Comparative steel 1 |
| B | 0 | 18 | 82 | 1097 | 0.81 | 843 | 0.77 | Comparative steel 2 |
| C | 0 | 9 | 91 | 1151 | 0.78 | 920 | 0.80 | Comparative steel 3 |
| D | 11 | 56 | 33 | 921 | 0.84 | 813 | 0.88 | Comparative steel 4 |
| E | 12 | 63 | 25 | 910 | 0.85 | 828 | 0.91 | Comparative steel 5 |
| F | 21 | 51 | 28 | 908 | 0.85 | 781 | 0.86 | Comparative steel 6 |
| G | 0 | 5 | 95 | 1153 | 0.77 | 914 | 0.79 | Comparative steel 7 |
| H | 0 | 30 | 70 | 1061 | 0.83 | 841 | 0.79 | Comparative steel 8 |
| I | 0 | 4 | 96 | 1086 | 0.73 | 817 | 0.75 | Comparative steel 9 |
| J | 0 | 25 | 75 | 1069 | 0.78 | 831 | 0.78 | Comparative steel 10 |
| K | 0 | 39 | 61 | 1033 | 0.84 | 894 | 0.87 | Inventive steel 1 |
| L | 0 | 31 | 69 | 1068 | 0.85 | 914 | 0.86 | Inventive steel 2 |
| M | 0 | 25 | 75 | 1113 | 0.83 | 904 | 0.81 | Inventive steel 3 |
| N | 0 | 29 | 71 | 1082 | 0.83 | 894 | 0.83 | Inventive steel 4 |

TABLE 3-continued

| Steel type | Microstructure (area %) Ferrite | Bainite | Martensite | Mechanical properties before heat treatment Tensile strength (MPa) | Yield ratio | Mechanical properties after heat treatment Tensile strength (MPa) | Tensile strength ratio before and after heat treatment | Classification |
|---|---|---|---|---|---|---|---|---|
| O | 0 | 20 | 80 | 1079 | 0.82 | 885 | 0.82 | Inventive steel 5 |
| P | 0 | 31 | 69 | 1054 | 0.81 | 851 | 0.81 | Inventive steel 6 |

As shown in Table 3, in the cases of Inventive Steels 1 to 6 satisfying the alloy composition and manufacturing method proposed in the present disclosure, all the mechanical properties targeted in the present disclosure were secured.

On the other hand, in the cases of Comparative Steels 1 and 2, the content of C was outside the scope of the present disclosure, and Comparative Steel 1 did not reach the content of C of the present disclosure, and thus the microstructure desired in the present disclosure was not secured, resulting in an insufficient tensile strength. In Comparative Steel 2, the content of C exceeded and was out of the range of Relational Expression 1, and therefore, the tensile strength ratio before and after the heat treatment was not satisfied.

In the cases of Comparative Steels 3 and 4, the content of Mn was outside the scope of the present disclosure, and in Comparative Steel 3, the content of Mn of the present disclosure exceeded, and Relational Expression 1 was also not satisfied. Due to this, the microstructure was not secured, and the yield ratio was also deteriorated. In Comparative Steel 4, it was difficult to secure the microstructure proposed in the present disclosure due to an insufficient content of Mn, and as a result, the tensile strength was also insufficient.

In the cases of Comparative Steels 5 and 6, the cooling conditions in the primary cooling were not satisfied, and the range of the cooling end temperature exceeded in Comparative Steel 5, and the cooling rate was insufficient in Comparative Steel 6. Therefore, the microstructure desired in the present disclosure was not satisfied, and the strength was insufficient.

In the case of Comparative Steel 7 in which the secondary cooling rate exceeded, the yield ratio was insufficient due to excessively formed martensite, and the tensile strength ratio did not satisfy the scope of the present disclosure due to a large change in tensile strength before and after the heat treatment.

In the case of Comparative Steel 8 in which Relational Expression 2 was not satisfied, the tensile strength ratio before and after the heat treatment proposed in the present disclosure was not satisfied due to a large change in tensile strength before and after the heat treatment.

In the case of Comparative Steel 9, as the primary cooling end temperature was excessively low, martensite was excessively formed, and thus, the yield ratio was insufficient, and the change in tensile strength before and after the heat treatment was excessive.

In the case of Comparative Steel 10, the secondary cooling end temperature was lower than the temperature range proposed in the present disclosure, auto-tempering was excessive, and thus, the yield ratio was insufficient, and the tensile strength ratio before and after the heat treatment was not satisfied.

Hereinabove, the present disclosure has been described in detail by the exemplary embodiments, but other exemplary embodiments having different forms are possible. Therefore, the technical spirit and scope of the claims set forth below are not limited by the exemplary embodiments.

The invention claimed is:

1. A steel sheet comprising: by wt %, 0.05 to 0.13% of C, 0.01 to 0.5% of Si, 0.8 to 1.8% of Mn, 0.005 to 1.2% of Cr, 0.001 to 0.5 of Mo, 0.001 to 0.02% of P, 0.001 to 0.01% of S, 0.01 to 0.1% of Al, 0.001 to 0.01% of N, 0.01 to 0.05% of Ti, 0.001 to 0.03% of Nb, 0.001 to 0.2% of V, 0.0003 to 0.003% of B, and a balance of Fe and unavoidable impurities;

a microstructure comprising, by area %, 60 to 75% of martensite including tempered martensite, 25 to 40% of bainite, and 5% or less of ferrite; and a yield ratio of 0.8 or more, wherein a K value defined in the following Relational Expression 1 is −1.05 or greater, and a G value defined in the following Relational Expression 2 is 2 to 20, $$K=-0.6-1.42[C]+0.05[Si]-0.16[Mn]-0.08[Cr]-0.03[Mo]+0.09[Ti]+0.08[Nb]^2 \quad \text{[Relational Expression 1]}$$

where [C], [Si], [Mn], [Cr], [Mo], [Ti], and [Nb] are wt % of the corresponding alloy components, $$G=([Nb]/93+[Mo]/96+[V]/51)/([Ti]/48) \quad \text{[Relational Expression 2]}$$

where [Nb], [Mo], [V], and [Ti] are wt % of the corresponding alloy components.

2. The steel sheet of claim 1, further comprising: a tensile strength of 950 MPa or more.

3. The steel sheet of claim 1, wherein a tensile strength of the steel sheet after a heat treatment at 400 to 600° C. is 80% or more of a tensile strength before the heat treatment.

* * * * *